United States Patent [19]

Stenz et al.

[11] 4,236,780

[45] Dec. 2, 1980

[54] MULTI-WAY TERMINAL BLOCK

[75] Inventors: Paul Stenz, Detmold; Hans-Herbert Kordt, Osterode, both of Fed. Rep. of Germany

[73] Assignee: C. A. Weidmuller KG, Detmold, Fed. Rep. of Germany

[21] Appl. No.: 26,258

[22] Filed: Apr. 2, 1979

[30] Foreign Application Priority Data

Apr. 17, 1978 [DE] Fed. Rep. of Germany ... 7811450[U]

[51] Int. Cl.[3] ..... H01R 9/26

[52] U.S. Cl. ..... 339/198 G; 339/198 GA; 339/272 A

[58] Field of Search ..... 339/198, 272 A

[56] References Cited

U.S. PATENT DOCUMENTS 4,018,502 4/1977 Glaesel ..... 339/198 GA

FOREIGN PATENT DOCUMENTS 1387554 3/1975 United Kingdom ..... 339/198 N

*Primary Examiner*—Richard B. Lazarus
*Assistant Examiner*—Eugene F. Desmond
*Attorney, Agent, or Firm*—Pollock, Vande Sande & Priddy

[57] ABSTRACT

An electrical multi-way terminal block having pairs of terminal in upper and intermediate regions, each pair being interconnected by a conductive member and being accessible for connection of a conductor. A tool access passage for one of the intermediate region terminals, which is offset into the interior of the block, extends from the upper face of the block transversely past the conductive member interconnecting the upper pair of terminals and is insulated from the latter, avoiding obstruction by a conductor connected to the upper terminals.

9 Claims, 6 Drawing Figures

MULTI-WAY TERMINAL BLOCK

This invention relates to electrical terminal blocks of the kind comprising a generally slab-shaped insulating housing having two major side faces, and intervening narrow faces, and having a base region for mounting on a support, for example a channel-section rail with inwardly or outwardly bent flanges.

Such terminal blocks are widely used to form terminal assemblies consisting of a plurality of terminal blocks mounted side by side, such an assembly being very compact, and versatile since a wide variety of assemblies can be built up from a relatively small number of types of terminal block.

For greater compactness, multi-way terminal blocks have been proposed so that a plurality of connections can be made in a single terminal block. One such terminal block is disclosed in German Utility Model Specification No. GM 76 13429, and comprises a stepped insulating housing with an earth terminal in the base region, a pair of interconnected phase-conductor terminals above this, and neutral-conductor terminals above the phase-conductor terminals. The individual terminals have clamping screws. A serious disadvantage of this is that conductors connected to upper terminals prevent access to the clamping screws of lower terminals; typically, the terminal block has a width of only 5 or 6 mm, whereas the conductors may be up to 4 mm thick, so that there is little space between conductors of adjacent terminal blocks. Consequently, after such a terminal block has been connected to the associated conductors, it is difficult or impossible to change the connections to the phase-conductor and earth terminals, without substantial disturbance or disconnection of other conductors.

An object of the present invention is to provide a multiway terminal block in which the above-mentioned disadvantage is overcome.

In one aspect, the present invention provides an electrical terminal block comprising a generally slab-shaped insulating housing having two parallel major side faces and intervening narrow faces, and having a base region for mounting on a support; a first terminal assembly in the region of the housing farthest from the base region and including first and second terminals interconnected by a conductive member and each accessible for connection of a conductor, conductor access to the first terminal being at a said narrow face facing in a first direction and disposed between the base region and the narrow face farthest from the base region; and a third terminal in a region of the housing between the base region and the first terminal assembly, the third terminal being accessible, for connection of a conductor, at a said narrow face facing in said first direction and disposed at a level between the base region and the first terminal, the third terminal also being accessible for application of a terminal-operating tool, by way of a tool-access passage which extends, from a said narrow face facing away from the base region, transversely past the said conductive member and is insulated from the latter.

In another aspect, this invention provides a triple rail-mounted terminal block with terminals for a neutral conductor, a protective conductor, and a phase conductor, all arranged in a terminal housing, the terminals being arranged in respective superimposed planes, conductor-insertion openings terminating at the front face of the terminal block and access openings for tools for actuating the terminals terminating on the upper surface of the terminal block, characterized in that the actuating member of a said terminal located in the intermediate plane is disposed, considered from the front face of the terminal block, offset into the interior of the terminal block beyond the actuating member of the terminal in the upper plane, and its tool-access opening is a passage which extends past the current conductor of the terminal located in the upper plane and is isolated therefrom.

In such terminal blocks, tool access to the third or intermediate terminal will not be obstructed by a conductor connected to the first or upper terminal, while the tool, for example a screw driver for operating a terminal clamping screw, is insulated from the said conductive member.

The conductive member may be made from flat metal, for example strip or sheet metal. To reduce its effective width it is preferably disposed, at least in its region past which the tool-access passage extends, with its plane substantially parallel to the major side faces of the insulating housing. To achieve this, this region of the conductive member may be twisted through a right angle, relative to one or both end regions of the conductive member at which respective terminals are provided. In this way, a tool-access passage of adequate width can be provided.

For ease of manufacture, the above mentioned first or upper terminal is preferably arranged in, or enclosed or covered by, an insert of insulating material attached to a main body of the insulating housing of the terminal block and provided with a portion which lies alongside the conductive member and at least partly defines the tool-access passage. This provides the necessary insulation between the tool-access passage and the conductive member, with a simple construction and easy manufacture. Furthermore, the insert can have a color different from that of the rest of the insulating housing, to indicate which kind of conductor is to be connected to the first or upper terminal.

In general, the third or intermediate terminal will be connected by a second conductive member to a fourth terminal thus forming a second terminal assembly.

A further terminal may be provided in the base region of the insulating housing, in such a way as to make contact with a support on which the terminal block is mounted, thus providing an earth connection. This further terminal can also be at least partly enclosed by an insert attached to the main body of the insulating housing and, if desired, of a distinctive color to indicate that it is an earth terminal.

The invention will be further described with reference to the accompanying drawings, in which.

Figure 2:
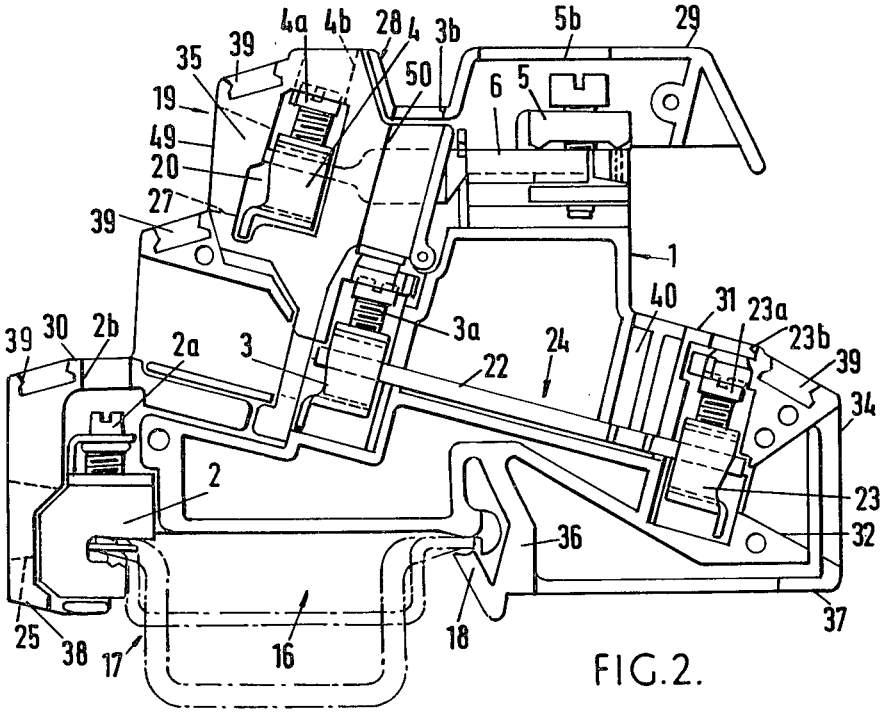
FIG. 2 is a side view of a second terminal block embodying the invention.
Figure 3:
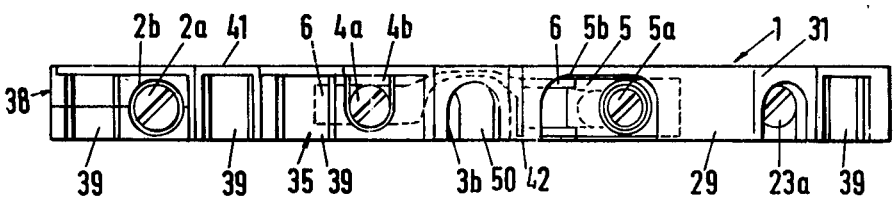
FIG. 3 is a plan view of the terminal block shown in FIG. 2.
Figure 4:
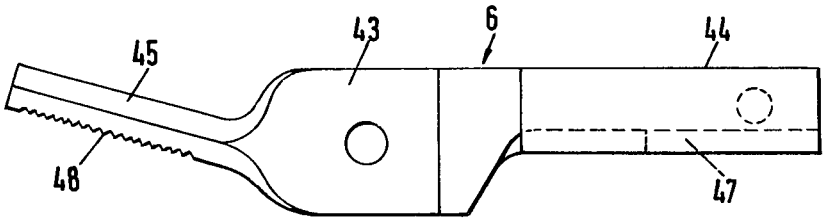
Figure 5:
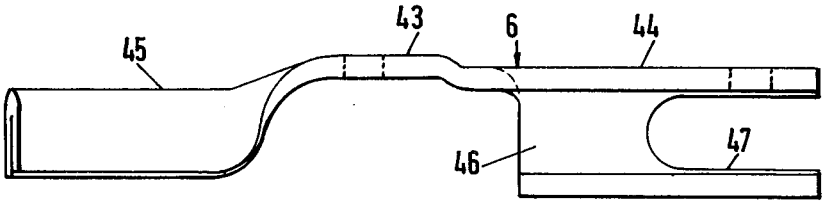
Figure 6:
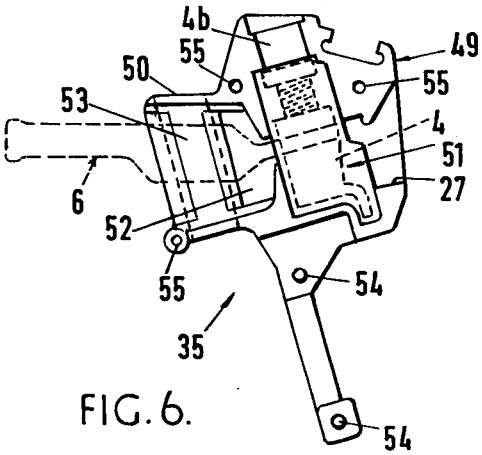

FIGS. 4 and 5 are respectively side and plan views of a conductive interconnecting member of the terminal block shown in FIGS. 2 and 3; and FIG. 6 shows an insulating insert of the terminal block shown in FIGS. 2 and 3, from the rear.

Figure 1:
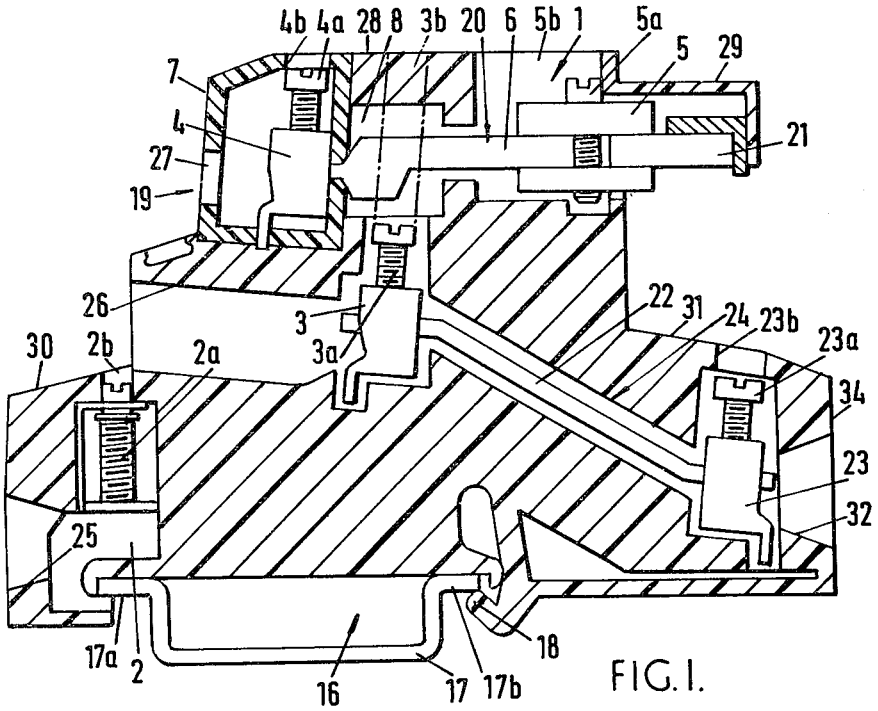
FIG. 1 is a side view, partly in section, showing schematically a first terminal block embodying the invention.

FIG. 1 shows a terminal block having a housing 1 of insulating plastic material, of generally slab-like form with two parallel major side faces, parallel to the plane of the drawing, and intervening narrow faces, typically only 6 mm wide. The housing has a base region 16 designed to enable the terminal block to be mounted on a support which, in the case illustrated in FIG. 1, is a metal rail 17 of channel section with outwardly turned flanges onto which the terminal block can be clipped.

For ease of description the terminal block will be described with reference to its orientation shown in FIG. 1, and furthermore the left-hand side of the block will be taken to be the "front" but it is to be understood that the terminal block can be mounted in any desired orientation and can be designed for mounting on a variety of supports, for example a rail with inwardly turned flanges, or a panel with a slot to receive a correspondingly shaped base region.

Such different mounting arrangements are well known and will not be described in detail. The terminal block is designed to be mounted side by side with other slab-like terminal blocks, and consequently access to the individual terminals can be had only by way of the narrow faces of the housing.

In the base region of the housing is an earth terminal 2 with a clamping screw 2*a*, by means of which an earth conductor can be clamped to the terminal and also the terminal can be clamped to one flange 17*a* of the rail 17, the other flange 17*b* being engaged by a resilient hook 18 of the insulating housing.

In the region farthest from the base region, i.e. the upper region 19 of the housing, is a first terminal assembly 20 for making a neutral connection. A terminal 4 for a neutral conductor is connected by a conductive member 6 to a slidable screw-clamp 5 which can grip a neutral busbar 21.

In an intermediate region, between the base region and the terminal assembly 20, is a terminal 3 for a live or phase conductor, this terminal being connected by a second conductive member 22 to a terminal 23, thereby forming a second terminal assembly 24.

To enable conductors to be inserted into the terminals 2,3,4, respective access openings 25 to 27 are provided at the front of the terminal block. These terminals have respective clamping screws 2*a*, 3*a*, 4*a*, each associated with a respective access opening 2*b*, 3*b*, 4*b* in a narrow face of the housing facing away from the base region, i.e., upwardly in FIG. 1, so that a screw driver can be inserted to turn the clamping screws. Relative to the terminal 4, the terminal 3 is set deeper into the insulating housing, to such an extent that its clamping screw 3*a* is behind the screw 4*a* of the neutral upper terminal 4. Consequently its access opening 3*b* is behind the access opening 4*b*, both openings being in the upper most narrow face 28 of the housing.

The access opening 3*b* comprises a passage extending transversely past the conductive member 6. To prevent contact between the member 6 and a tool inserted in the access passage 3*b*, an insulating plate 8 is provided between the member 6 and the access passage.

In the illustrated terminal block, this plate is integral with and projects from a separate housing part or insert 7 of insulating plastic material which encloses the terminal 4 and is permanently or detachably secured to the remainder of the housing 1.

It will readily be understood that the access passage 3*b* cannot be obstructed by a conductor inserted in the terminal 4, or any other terminal of the terminal block.

The conductive member 6 is made of flat metal and, in the region adjacent to the plate 8, is twisted through a right angle so that its plane is parallel to the major side faces of the housing, i.e., edgewise relative to the base region, so that its effective width is the smallest possible and therefore the greatest possible amount of space is left for the access passage 3*b*. Consequently, an access passage of sufficient width to receive a screw driver can be provided even in a narrow terminal block.

The clamp 5 has a clamping screw 5*a* accessible through a further opening 5*b* in the uppermost face of the housing, and when the clamping screw is released the clamp can be slid along the conductive member 6 so as to be clear of the busbar 21. A protective cover 29 for the busbar is provided on the insulating housing 1.

The clamping screw 2*a* of the earth terminal, and the clamping screw 23*a* of the live terminal 23, are accessible through access openings 2*b* and 23*b* in respective narrow faces 30, 31 of the insulating housing, facing away from the base region. The insulating housing has a stepped profile at the front and rear to accommodate these terminals and to facilitate access to their clamping screws. A conductor can be inserted into the terminal 23 through an aperture 32 in a rear narrow face 34 of the housing.

FIGS. 2 and 5 show in more detail a terminal block generally similar to that of FIG. 1. Corresponding parts are identified by the same reference numerals as in FIG. 1 and will not be described again, except so far as necessary to describe features of the terminal block shown in FIGS. 2 to 5 that have not already been described in relation to FIG. 1.

It will be seen that FIG. 2 shows two different forms of supporting rail 17, and also shows that the retaining portion 18 of the insulating housing is secured to the rest of the housing only by two thin arms 36, 37, so that it can be moved clear of the support rail to release the terminal block from the latter when the earth terminal 2 is unclamped from the rail. It can also be seen that the earth terminal is enclosed by an insert 38 of insulating material, permanently or detachably secured to the main part of the insulating housing 1 and optionally of a color different from the latter in order to identify the terminal 2 as an earth terminal.

Further means of identification for individual terminals and for the terminal block as a whole are provided by recesses 39 for receiving identifying tabs in known manner.

FIG. 2 also shows an opening 40 in the narrow face 31, through which a test prod can make contact with the "live" terminal assembly 24. This opening may accommodate a test socket attached to the conductive interconnecting bar 22 of the terminal assembly.

FIG. 3 clearly shows the narrow slab shape of the insulating housing. One of the parallel major side faces 41 is flat and imperforate (though, in some cases, windows may be provided in it for cross-connections), but the other major side face 42 is recessed to accommodate the terminal assemblies, and also to save weight and material.

The most important difference between the terminal blocks shown in FIGS. 1 and 2 is in the arrangement of the upper, neutral, terminal assembly and the provisions for access to the live or phase terminal 3.

The conductive member 6 of the terminal block shown in FIGS. 2 and 3 is shown in detail in FIGS. 4 and 5. It is made of sheet or strip metal, punched and bent to the illustrated shape.

The member 6 has an intermediate portion 43 which is substantially flat, a first end portion 44 of channel section, the portion 43 being a continuation of one flange of the channel, and a second end portion 45 in which the metal is folded about a longitudinal center line to form a flat bar of which the main plane is perpendicular to that of the intermediate portion 43 and oblique relative to the web 46 of the channel section. The web 46 has a slot 47 to receive the clamping screw 5*a*, and the plates which with this screw form the clamp 5 grip the flanges of the channel section. The bar-end region 45 extends into a clamping sleeve of the terminal 4 and its underside may have serrations 48 to grip the inserted conductor.

The intermediate region 43 is parallel to and lies against the internal surface of the insulating housing adjoining the major side face 41 as shown in FIG. 3 and the effective width of the member 6 in this region is therefore equal only to the thickness of the metal strip or sheet, typically 0.8 mm. This region of the member 6 is directly below the tool-access opening 3*b* in the upper narrow face of the housing, and its small width in this region, and the lateral offset of this region clearly visible in FIG. 5, assure that ample space is available within the housing for insertion of a screw-driver to operate the screw 3*a*.

The terminal 4, and the regions 43 and 45 of the member 6, are enclosed by an insulating insert 35 permanently or detachably secured to the main body of the housing 1 and optionally of a different color from the latter to identify the terminal

4. More specifically, the terminal 4 and member 6 are trapped between the insert 35 and an internal surface of the main housing body adjoining the major side face 41. The insert has a side face flush with the major side face 42, and also defines part of the upper narrow face 28 of the housing including the tool-access opening 4*b*, and the front narrow face 49 of the housing, including the aperture 27 for insertion of a conductor into the terminal 4.

The rear part of the insert 35 defines a U-section channel 50 aligned with the opening 3*b* and the screw 3*a* and open towards the major side face 42. The base region of this channel therefore insulates the conductive member 6 from a screw-driver inserted through the opening 3*b*.

FIG. 6 shows the rear of the insert 35, which has an aperture 51 which receives the terminal 4. This aperture communicates with the aperture 27, the opening 46, which is a U-section channel facing the internal surface of the main housing body, and with a recess 52 between the aperture 51 and a semi-cylindrical surface 53 within which is the channel 50; the recess 52 accommodates the junction of the regions 43 and 45 of the member 6, as shown in dotted lines FIG. 6. FIG. 6 also shows pins 54 and holes 55 to fit respective holes and pins provided on the main housing body to retain the insert 35.

I claim:

1. A triple rail mounted terminal block with terminals for a neutral conductor, a protective conductor and a phase conductor, all arranged in a terminal housing, having an upper surface and a front face, said terminals being arranged in respective superimposed planes, conductor insertion openings terminating at said front face of said terminal block and access openings for tools for actuating said terminals terminating on said upper surface of said terminal block, the actuating member of a said terminal located in the intermediate plane being disposed, considered from said front face of said terminal block, offset into the interior of said terminal block beyond said actuating member of the terminal in the upper plane, and its tool access opening is a passage which extends past the current conductor of the terminal located in the upper plane and is isolated therefrom.

2. A terminal block as claimed in claim 1, in which the current conductor of the terminal located in the upper plane is a bar which is twisted into an on-edge position at least in the nitrogen crossed by said tool access passage.

3. A terminal block as claimed in claim 1, in which the terminal in the upper plane is arranged in an individual housing locked together with said terminal housing, and an insulating plate projecting from said individual housing extends between said current conductor and said tool access passage crossing said current conductor.

4. An electrical terminal block comprising (a) a generally slab-shaped insulating housing having two parallel major side faces and intervening narrow faces, and having a base region for mounting on a support;

(b) a first terminal assembly in the region of said housing farthest from said base region and including first and second terminals interconnected by a first conductive member and each accessible for connection of a conductor, conductor access to said first terminal being at a said narrow face facing in a first direction and disposed between said base region and the narrow face farthest from said base region; and (c) a third terminal in a region of said housing between said base region and said first terminal assembly, said third terminal being accessible, for connection of a conductor, at a said narrow face facing in said first direction and disposed at a level between said base region and said first terminal, said third terminal also being accessible for application of a terminal operating tool, by way of a tool access passage which extends, from a said narrow face facing away from said base region, transversely past said first conductive member and is insulated from the latter.

5. An electrical terminal block as claimed in claim 4, comprising a second terminal assembly in a region of said housing between said base region and said first terminal assembly and including said third terminal and a fourth terminal interconnected by a second conductive member.

6. An electrical terminal block comprising (a) a generally slab-shaped insulating housing having two parallel major side faces and intervening narrow faces, and having a base region for mounting on a support;

(b) a first terminal assembly in the region of said housing farthest from said base region and including first and second terminals interconnected by a first conductive member; and (c) a second terminal assembly, in a region of said housing between said base region and said first terminal assembly and including third and fourth terminals interconnected by a second conductive member;

(d) said first terminal being accessible, for insertion of a conductor, at a said narrow face facing in a first direction and disposed between said base region and the narrow face farthest from said base region;

(e) said second terminal being accessible, for insertion of a conductor, at a said narrow face facing in a direction opposite to the said first direction, and disposed between said base region and the narrow face farthest from said base region;

(f) said third terminal being accessible, for insertion of a conductor, at a said narrow face facing in said first direction and disposed between said base region and said first terminal assembly;

(g) said fourth terminal being accessible, for insertion of a conductor, at a said narrow face facing in the said opposite direction and disposed between said base region and said first terminal assembly;

(h) each said terminal being accessible, for application of a terminal operating tool, through a tool access opening in a said narrow face facing away from said base region;

(i) the tool access to said third terminal being by way of a tool access passage which extends transversely past and is electrically insulated from said first conductive member.

7. A terminal block as claimed in claim 4 or 6, further including a terminal in said base region of said housing, arranged and adapted to make contact with a said support.

8. A terminal block as claimed in claim 4 or 6, in which said first conductive member past which said tool access passage to said third terminal extends consists of flat metal which, at least in its region past which said tool access passage to said third terminal extends, is disposed with its plane substantially parallel to said major side faces.

9. A terminal block as claimed in claim 4 or 6, in which said housing comprises a main body, and an insert which encloses said first terminal and has a portion which is disposed alongside said first conductive member and defines said tool access passage for said third terminal.

* * * * *

UNITED STATES PATENT AND TRADEMARK OFFICE

CERTIFICATE OF CORRECTION

PATENT NO. : 4,236,780

DATED : December 2, 1980

INVENTOR(S) : Paul Stenz et al.

It is certified that error appears in the above-identified patent and that said Letters Patent are hereby corrected as shown below:

Claim 2, line 4, the word "nitrogen" should read --region--.

Signed and Sealed this

*Seventeenth* Day of *March 1981*

[SEAL]

*Attest:*

RENE D. TEGTMEYER

*Attesting Officer*

*Acting Commissioner of Patents and Trademarks*